United States Patent [19]

Bodine et al.

[11] Patent Number: 4,666,157

[45] Date of Patent: May 19, 1987

[54] GOLF COURSE PLAYING APPARATUS

[75] Inventors: Jane A. Bodine, 5539 N. 12th St., Phoenix, Ariz. 85014; Charles J. Deihl, 5615 S. 41st St., Phoenix, Ariz. 85040; Henry A. Deihl, 9835 N. 47th Pl., Phoenix, Ariz. 85028; Paul E. Gramze, 2904 W. Curry, Chandler, Ariz. 85224; Monty Kiel, Phoenix, Ariz.

[73] Assignees: Jane A. Bodine, Phoenix; Charles J. Deihl, Phoenix; Henry A. Deihl, Phoenix; Paul E. Gramze, Chandler, all of Ariz.

[21] Appl. No.: 794,781

[22] Filed: Nov. 4, 1985

[51] Int. Cl.[4] ..... A63B 67/02

[52] U.S. Cl. ..... 273/32 H; 434/252

[58] Field of Search ..... 273/32 H, 176 L, 32 R, 273/32 B, DIG. 28; 434/252

[56] References Cited

U.S. PATENT DOCUMENTS 3,820,786 6/1974 Candor ..... 273/32 H 4,331,425 5/1982 Davis ..... 434/252

*Primary Examiner*—George J. Marlo

*Attorney, Agent, or Firm*—H. Gordon Shields

[57] ABSTRACT

Golf course playing apparatus includes a booklet showing the layout of each hole on the golf course with distance grids marked thereon so that ball locations from each stroke may be identified and located for statistical correlation of strokes with different golf clubs, and a score card is included which is consecutively exposed on a hole-by-hole basis. In addition, the booklet apparatus includes space for other information, such as historical information, instruction, advertising, and the like. A computer system is provided for compiling statistical information from the recorded information.

11 Claims, 12 Drawing Figures

GOLF COURSE PLAYING APPARATUS

BACKGROUND OF THE INVENTION

1. Field of the Invention

This invention relates to golf course booklet apparatus, and, more particularly, to golf course booklet apparatus including provisions for showing diagrams of each hole, a grid layout for plotting strokes, and a score card.

2. Description of the Prior Art

There are prior art books and booklets which show golf course layouts, and which include historical information regarding the particular golf course. In addition, there are typical golf score cards which are simply cards showing the number of strokes for each hole by each player. However, the two have not been combined since generally a brochure or booklet regarding a particular golf course is generally of a size which is not convenient for carrying by a player while playing on a golf course. In addition, it is generally much more convenient for a player to simply put a score card in a pocket for carrying and using the score card while playing on the golf course. The golf score cards accordingly are relatively small so that they may be conveniently carried in a shirt pocket.

Books or brochures which describe in detail golf courses, including the diagrammatic layouts of individual holes, are generally relatively large and are designed to be a shelf item, as opposed to being a carryable item. The books or booklets or brochures are are designed to be used in a home, or in a lounge, but are not designed to be carried on the golf course while playing. The booklets are not designed to be utilized on a practical basis for recording ball locations for each stroke. Accordingly, such booklets or brochures, while interesting, are practical only on an informational basis, as opposed to a useful basis. They cannot be conveniently carried on a golf course and utilized while on the golf course. Such brochures or booklets accordingly are more for reference information than for field notations.

The apparatus of the present invention allows a player to functionally record each stroke in terms of distance and club used on a stroke-by-stroke basis. Such information, when compiled over a period of time, provides detailed information to not only the player, but also to appropriate personnel who develop handicaps for players and for golf professionals or coaches who instruct golfers. The apparatus of the present invention accordingly comprises a practical field note apparatus for golf courses which has heretofore not been available to golfers.

SUMMARY OF THE INVENTION

The invention described and claimed herein comprises a booklet or brochure having golf course diagrammatical information on a hole-by-hole basis and a grid system for each hole to enable a player to record location and club information for each stroke. In addition, score information is provided on a scorecard attached to the booklet and disclosed on a hole-by-hole basis along with the diagram of each hole.

Among the objects of the present invention are the following:

To provide new and useful field note apparatus for recording information on a golf course;

To provide new and useful layout information for a golf course on a hole-by-hole basis.

To provide new and useful booklet apparatus for recording distance and club information for a player on a golf course; and To provide new and useful apparatus for statistically analyzing a golf player's hitting ability with different golf clubs.

DESCRIPTION OF THE PREFERRED EMBODIMENT

Figure 1:
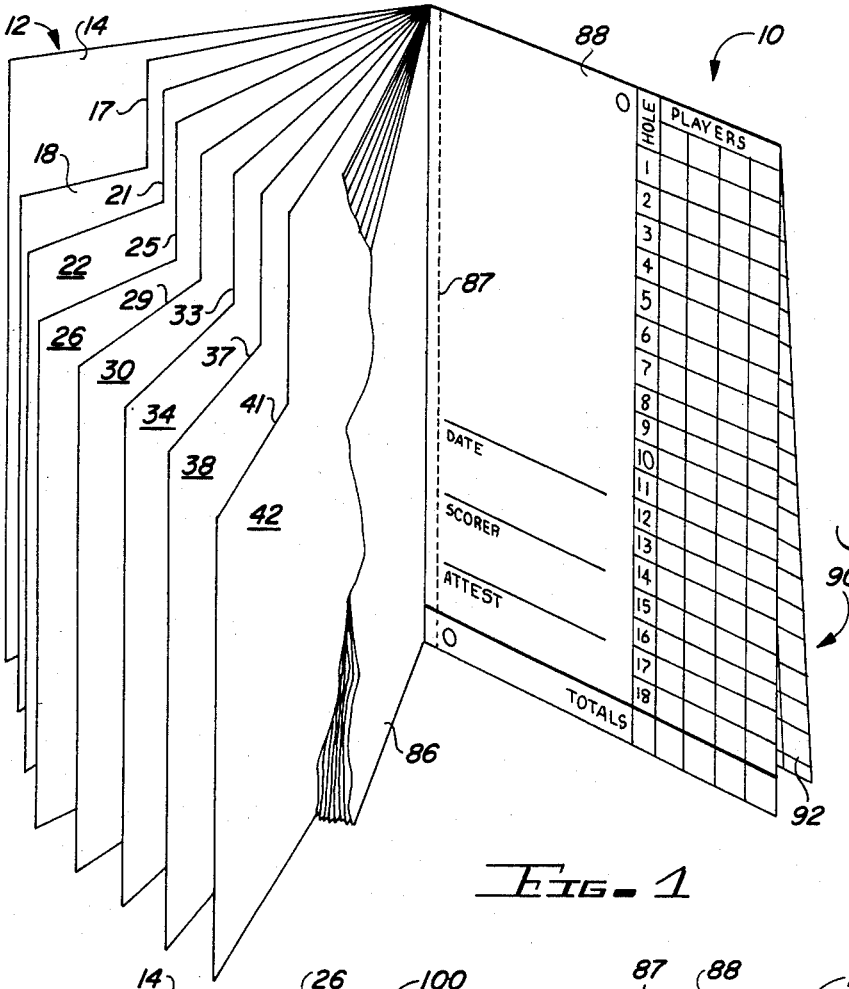
FIG. 1 is a perspective view of the apparatus of the present invention.

FIG. 1 is a perspective view of golf booklet apparatus 10 embodying the present invention. The golf booklet apparatus 10 consists of a plurality of leaves secured together in booklet form, with each leaf slightly different from the other leaves. The booklet includes a front cover 12 and a back cover 90. The inside of the front cover comprises a page 14, and the inside of the back cover comprises a page 92. The page 14 may include historical data, or information concerning the golf course, of it may include advertising material, as desired. It may also include instructions for the booklet or for playing golf, or other information, as desired.

The inside page of the back cover 90 comprises a score card 92, which cooperates with a removable score card page 86 to provide a permananet record of the scores of the users of the booklet apparatus 10. The score card page 92 may comprise a score card copy for which no carbon paper is required. Thus, the user (golf player) of the booklet apparatus 10 simply records scores on the removable score card page 88, and an impression or copy, in duplicate, is also made on the score card page 92. The inside edge of the removable score card page 88 comprises a scored line 87 for easy removal of the page 88.

FIG. 1 shows both the removable score card page 88 and the "permanent" score card page 92, which is the inside of the back cover 90, connected as "ordinary" pages or leaves of the booklet apparatus 10. If desired, the pages 88 and 90 may be connected together at their outer edges, with their juncture perforated for easy removal of the score card 86.

Between the cover 12 and the score card page 88 are at least eighteen leaves or sheets, each of which includes a front page and a back page. The back page of one leaf is a facing page for the next successive page or leaf. The front or right-hand pages are primary pages, each of which includes a detailed layout of each hole. The first primary page includes a detailed layout of the first hole, the second primary page includes a detailed layout of the second hole, etc., so that users of the booklet apparatus 10 have detailed information concerning each hole of the golf course.

In FIG. 1 there are shown seven of the leaves or sheets of the booklet apparatus 10. Some of the pages are illustrated in detail in FIGS. 2, 4, and 6A–6F.

When viewing the booklet, the hole information is disclosed on the primary, right-hand pages, with advertising or historical information or golf instruction tips, etc., on the left-hand, facing pages. The left-hand page is considered as a facing page, and will be so indicated hereafter.

Figure 6A:
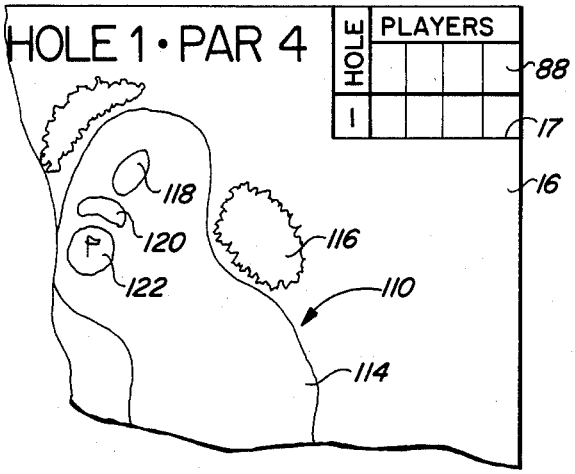
FIGS. 6A–6F are fragmentary views sequentially illustrating the apparatus of the present invention.
Figure 6B:
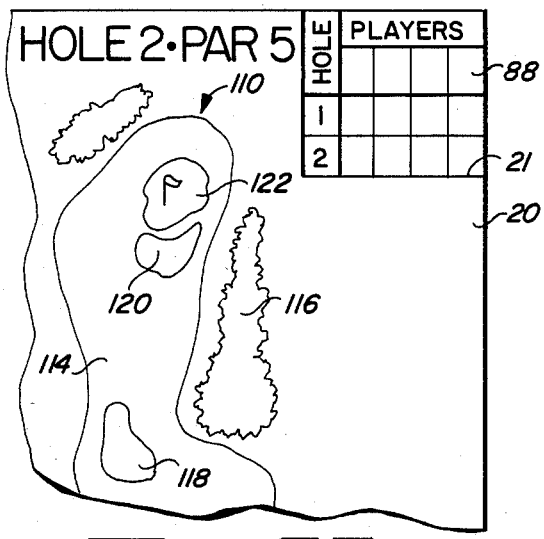

A page 16 shows a detailed diagram of hole 1. The page 16 is illustrated in FIG. 6A. The back side of page 16 comprises a facing page 18 for a primary page 20, which is a hole page. Page 20 is illustrated in FIG. 6B. In the upper right-hand corner of page 16, which is the upper left-hand corner of page 18, there is a rectangular cutout area 17. The purpose of the cutout area 17 is to allow a user to have access to the portion of the score card page 88 which refers to hole 1. This is also illustrated in FIG. 6A.

A page 20, shown in FIG. 6B, provides detailed information for hole 2. Again, page 18, the opposite or facing page for page 20, and the backside of page 16, provides space for advertising, historical information, golf playing tips, etc.

A cutout portion 21 in the upper right hand corner of page 20 provides access to the score card 86 for hole 2.

Figure 2:
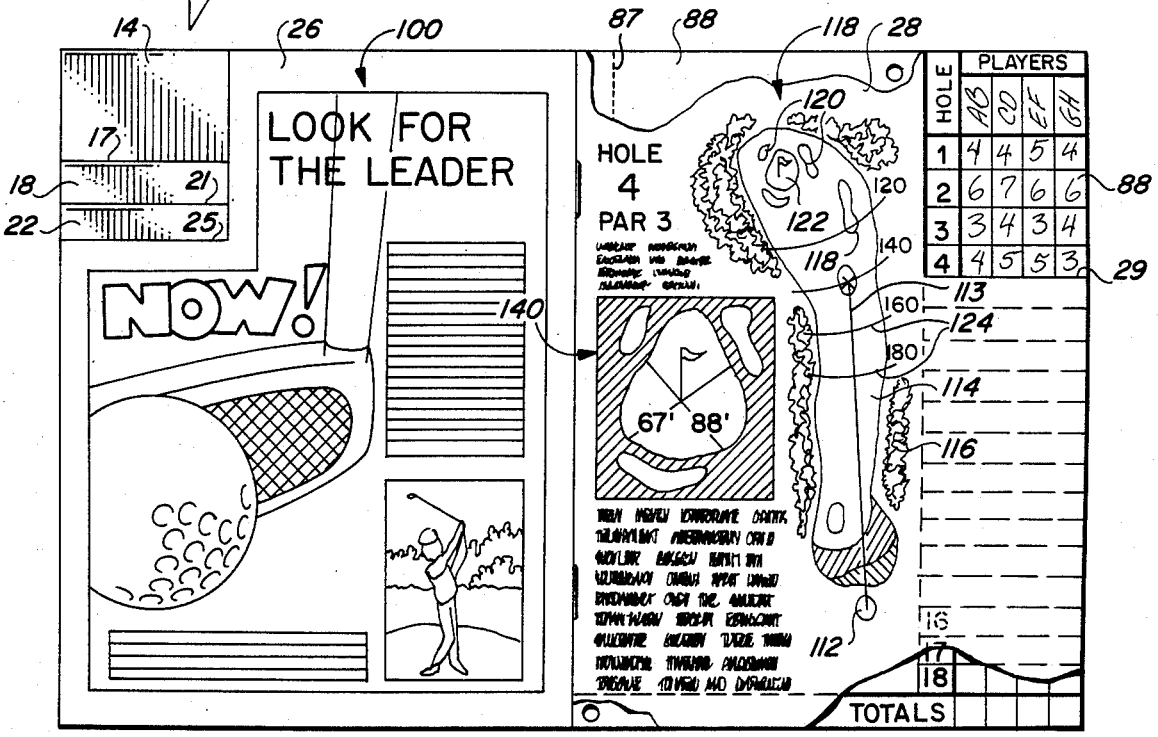
FIG. 2 is a plan view of a portion of the apparatus of the present invention.
Figure 6C:
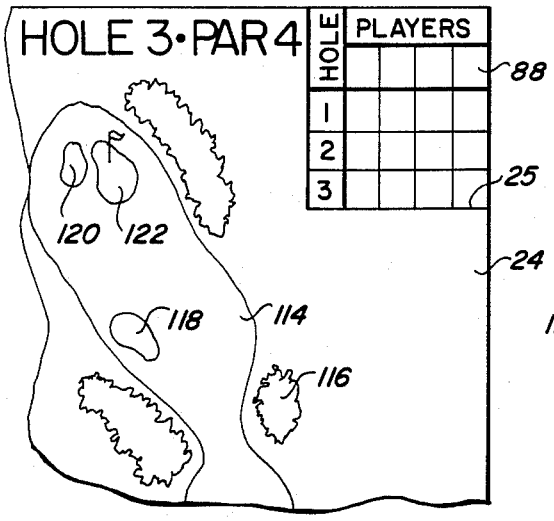

The reverse of page 20, namely page 22, comprises the facing page for primary page 24. Page 24 includes the hole information for hole 3. This is illustrated in FIG. 6C. The reverse of page 24 comprises page 26, the facing page for page 28. Page 28 includes the hole information for hole 4. Pages 26 and 28 are illustrated in FIG. 2.

Figure 4:
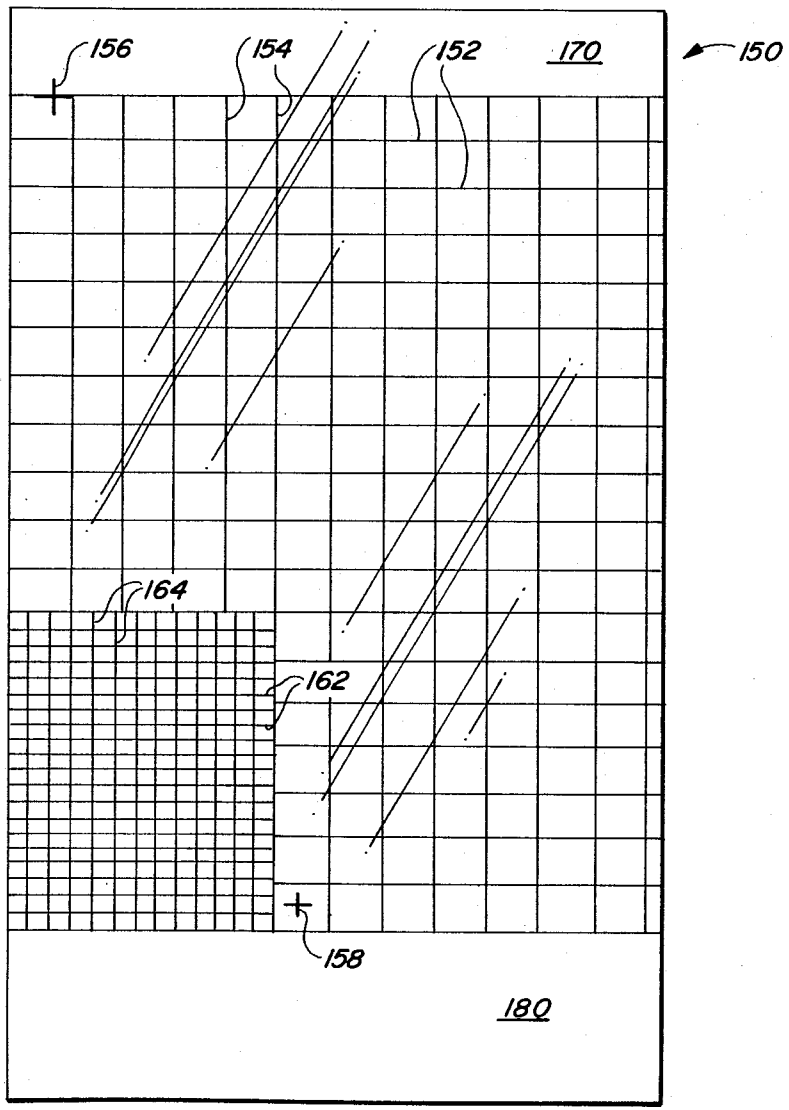
FIG. 4 is a plan view of another portion of the apparatus of the present invention.

Facing page 30, the reverse side of page 28, faces primary page 32. The layout for hole 5 is shown on page 32. Page 32 is shown in FIG. 4.

Figure 6D:
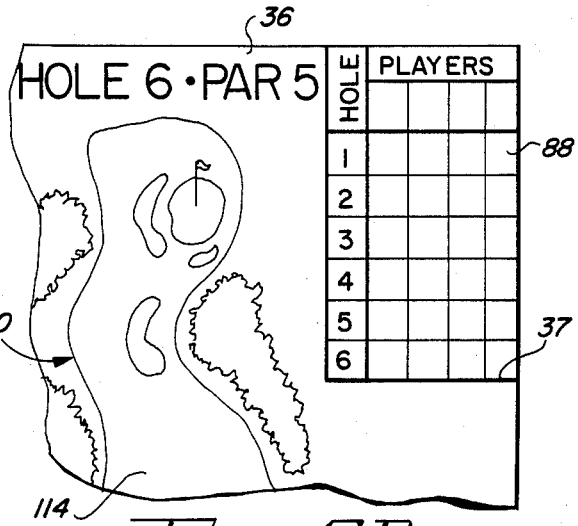

The reverse of primary page 32 is facing page 34, which faces page 36 (see FIG. 6D.) Page 36 shows the hole information for hole 6. Facing pages 38 and 42, and also facing page 86, are illustrated in FIG. 1. The facing pages 38 and 42 are respectively facing pages for the pages providing layout information for holes 7 and 8. The facing page 86 is opposite to score page 88.

As illustrated in FIG. 1, there are a plurality of primary or hole pages and facing pages between facing page 42 and facing page 86. (The plurality of pages not shown in detail would include hole layouts for the rest of the holes and the facing pages for the hole layouts.)

The upper right hand corners of the hole pages, which also comprise the upper left hand corners of the facing pages, are sequentially cut lower to allow access to the portion of the score card page 86 which pertains to the particular hole being played. The cutout portions include cutout portions 21, 25, 29, 33, 37, and 41, which apply respectively to pages 20–22, 24–26, 28–30, 32–34, 36–38, and 40–42.

Figure 6E:
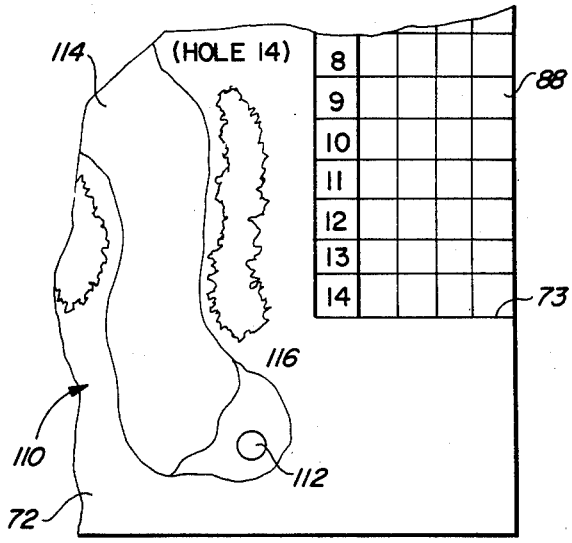
Figure 6F:
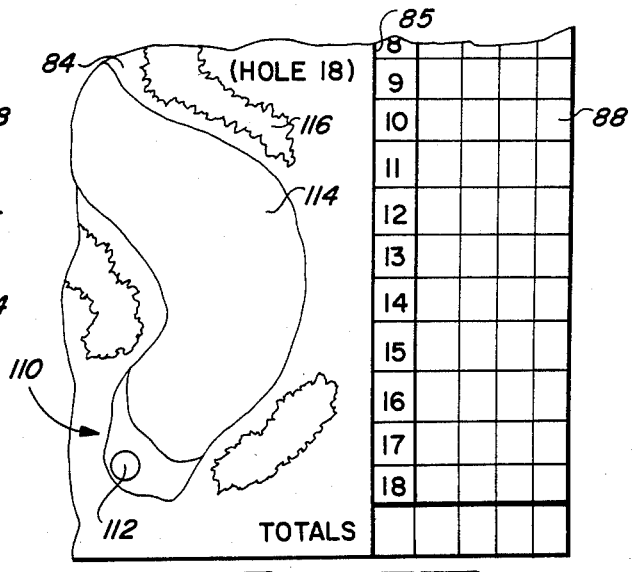

In addition to the pages illustrated in FIGS. 1, 2, 4, and 6A, 6B, and 6C, there are additional primary pages illustrated in FIGS. 6D, 6E, and 6F. They will be discussed in more detail below. They include primary pages 36, 72, and 84, respectively, for FIGS. 6D, 6E, and 6F. The diagrams shown on the pages correspond, respectively, to holes 6, 15, and 18 of a golf course for which the booklet apparatus 10 illustratively pertains.

FIG. 2 is a plan or front view of primary page 28 and facing page 26. The cutout portion 25 for facing page 26 (and the reverse of page 26, which comprises primary page 24) is shown, as are the cutout portion 21 and a portion of facing page 22, cutout portion 17 and a portion of facing page 18, and a portion of page 14, the inside front cover page. The cutout portions 21, 25 and 29 are each sequentially lower than the previous cutout portion to reveal, or to provide access to, the next sequential hole portion of the score card page 88. It will be noted that the first cutout is "deeper" proportionately than the succeeding cutouts because it reveals the entire top or heading portion of the score card as well as the hole 1 portion.

On facing page 26 there is advertising material 100. The advertising material 100 may occupy the entire page, or, as indicated above, historical information, instructional information, or the like, or combinations thereof, may be included or may be presented on the page.

On primary page 28 there is shown a detailed hole diagram 110 for the fourth hole of the golf course for which the booklet apparatus 10 illustratively pertains. Included in the hole diagram or detailed layout 110 is a tee 112, a fairway 114, bounded by rough, shrubs, etc., 116. Also, hazards 118 are shown. A plurality of sand traps 120 are shown disposed about a green 122. A drive line 113 extends from the tee 122, with an "X" showing where the ball landed from the tee shot.

A plurality of arcuate lines 124 are used to show distances from the green 122. Four such lines 124 are shown, with yardage numbers 20, 60, 80, and 100 at the ends of the arcs, indicating distances from the green 122 for each arc.

The cutout 29 in the upper right hand corner of page 28 provides access to the removable score card page 88, and specifically provides access to the part of the score card which pertains to the score (stroke) information for hole 4.

Page 28 also includes an enlargement 140 of the green 122. In addition, there is space available for other information, as desired.

Figure 3:
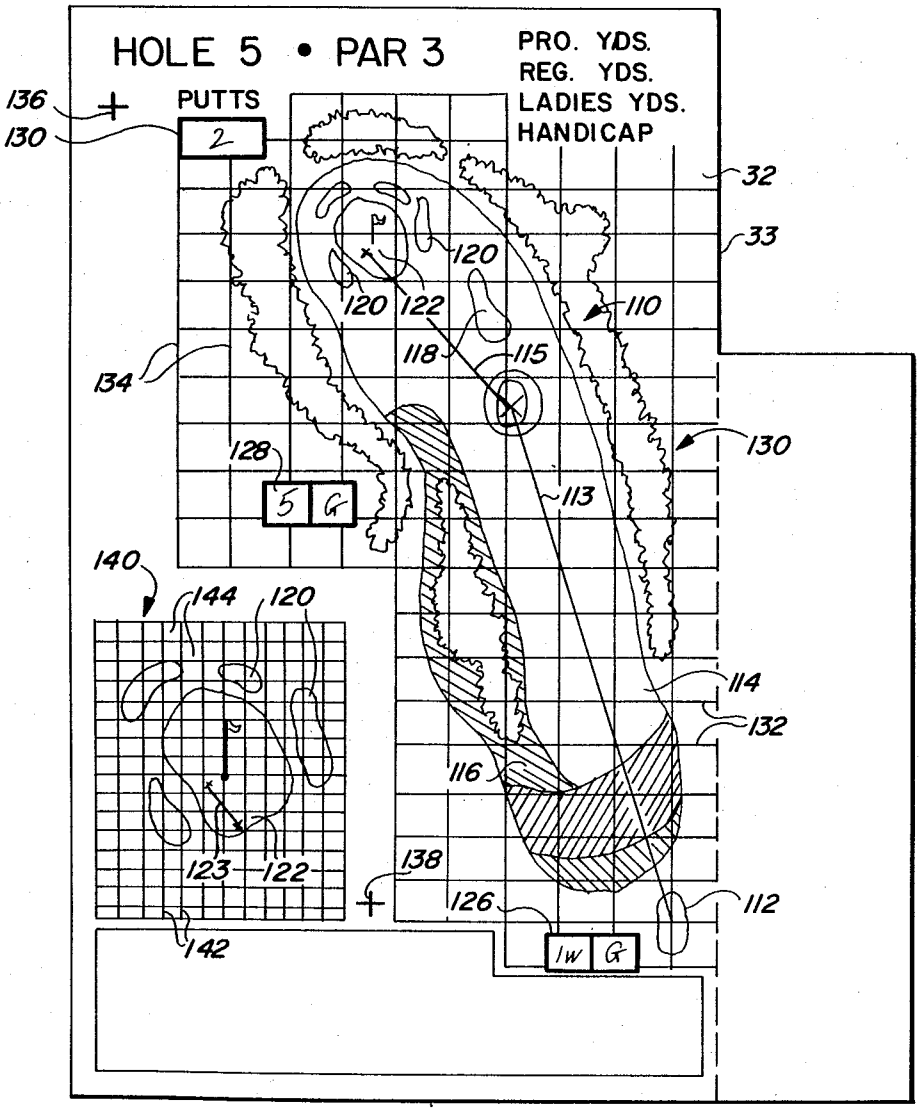
FIG. 3 is a plan view of another portion of the apparatus of the present invention.

An enlargement of primary page 32, which comprises the layout for the fifth hole, is shown in FIG. 3. Additional details which may be included in the hole diagrams or layouts 110, and of other features of the apparatus of the present invention are illustrated in FIG. 3.

Information for the fifth hole is shown at the top of page 32 in terms of basic golf course information, such as the par for the hole, the total yardage for the hole for men and for women, and the handicap. The tee 122 is shown, along with the fairway 114, the rough, shrubs, etc. 116, and the hazards 118 on the fairway. The sand traps 120 about the green 122 are also shown. In addition, three tracking blocks 126, 128, and 130 are shown adjacent to the hole diagram 110. The tracking blocks each include at least two portions, and may include more.

The tracking blocks 126, 128 and 130 are used by players to denote the clubs used and, if desired, an analysis of each stroke. For example, in tracking blocks 126, if a player uses a 1 wood, the first block or square may indicate a "1W" for a 1 wood, and the second square may indicate an analysis of the drive, such as "G" for "good", "S" for "short", "L" for "long", "H" for "hook", "SL" for "slice", etc. As shown, there is a "G" in the second block, indicating a "good" drive. Obviously, players may use any type of coding system they desire.

In addition to the tracking blocks and distance arcs, there are a plurality of grid lines on the hole layout 110. There are a plurality of horizontal grid lines 122 and a plurality of vertical grid lines 134. The grid lines preferably represent ten yard intervals. The grid lines may be used by a player to rather specifically denote the distance and location of each stroke. For example, in FIG. 3 there is shown a drive line 113 which represents the flight of the ball from the tee 112. The location of the ball is marked by an "X" or by any other desired symbol. For multiple players, multiple symbols must be used, with a different symbol for each player. The first drive or stroke by the player, represented by the line 113, went about 120 yards. In the first square of tracking block 126 is represented "1W" for a 1 wood, and in the second block is a "G" for a "good" drive from the tee 112. Distance arcs 124 are also shown in FIG. 3, as well as the grid lines 132 and 134.

The tracking block 128 is next used to record the second stroke of the player, including the particular iron (a "5" iron) used and an analysis of the stroke ("G" for good). The grid lines 132 and 134 may be used again to specifically locate the second stroke. A drive line 115 shows the flight of the ball for the second stroke. With the second stroke 11, the player reached the green 122, and the block 128 records the appropriate information.

The tracking block 130 is used to record the number of putts required to complete the hole play. Illustratively, two putts were required.

For diagrammatically recording the putting information, the green enlargement 140 is used. The green enlargement 140 is, of course, an enlarged view of the green 122 and its sand trap 120. A plurality of grid lines are used on the green enlargement 140 to aid in putting. The grid lines include a plurality of horizontal grid lines 142 and a plurality of vertical grid lines 144. The grid lines 142 and 144 preferably represent ten foot increments, as opposed to the ten yard increments of the grid lines 132 and 134.

On enlargement 140, the first putt 123 is shown as being short. The second putt need not be shown since it was successful. However, the first putt 123 is shown as extending from the location shown on the large diagram 110 to within somewhat less than ten feet from the cup.

A cup (pin) location for the green 122 is shown on both the hole layout 110 and the enlarged green layout 140. Such information may not always be included since the cup (pin) locations change periodically.

Distance arcs 124 are also shown in FIG. 3. The distance arcs 124 are in addition to the grid lines 132 and 134.

The tracking system illustrated in FIG. 3 for both the hole and the fairway may also be included on a separate overlay, such as is shown in FIG. 4. FIG. 4 is an enlarged view of an overlay 150 usable with each of the hole pages, the primary pages, of the booklet apparatus 10 of the present invention. The overlay sheet 150 may be a third "mylar" film or any other appropriate transparent material. Several plastic materials may be suitable for the film.

The overlay page 150 may be inserted over each hole, or primary page, such as the page 32 of FIG. 3. The overlay preferably includes a plurality of grid lines, including a plurality of horizontal grid lines 152 and a plurality of vertical grid lines 154. The grid lines 152 and 154 correspond to, and should overly, the grid lines 132 and 134, respectively, of the primary pages. The grid lines 152 and 154 are, accordingly, based on ten yard increments.

A second set of grid lines for the enlarged green grid is also included on the overlay page 150. The green grid lines include a plurality of horizontal grid lines 162 and a plurality of vertical grid lines 164. The grid lines 162 and 164 correspond to the grid lines 142 and 144, respectively, of the enlarged green grid system 140 of the hole or primary pages, and are therefore based on the feet increments.

To insure that the overlay pages 150 match with each hole page, the hole pages and the overlay pages include registration or alignment marks. Referring again to FIG. 3, there is a pair of registration marks shown. The registration marks include an upper registration mark 136 and a lower registration mark 138. A corresponding pair of registration marks is also included on overlay page 150. The pair includes an upper registration mark 156 and a lower registration mark 158. When the marks 156 and 158 are aligned with, and thus overly, the registration marks 136 and 138, the grid lines line up in an overlying relationship. Locations marked on the film overlay 150 then correspond to the distances and locations for each stroke played on a given hole.

At the top of the overlay 150 is a blank area 170, and at the bottom of the overlay 150 is a blank area 180. The blank areas may be filled in with information, as desired by the player. For example, if universal overlay sheets are used, the blank areas 170 and 180 may be used to identify each hole, the player(s), and they may be used for any other desirable information.

When the overlay sheets 150 and/or the primary (hole) pages are magnetically or some other way encoded with the distance information, and each club is identified for each stroke, then the information may be statistically compiled from either the overlay sheets or the primary pages. For example, statistical information on each hole played, how many strokes to the green, and how many putts on the green may be compiled for each player. The average distance obtained with each golf club may be computed, consistent errors, such as slices or hooks, may be compiled, along with other statistical information. Such information may be compiled manually or may be compiled by means of a computer, appropriately programmed. Information may be taken from either the primary pages of the booklet 10 or from overlay pages 150.

The film overlay pages may be bound as integral but removable sheets or leaves in the booklet apparatus 10, if desired. In the alternative, the sheets may be separate and loose, simply inserted over the pages in the booklet and appropriately registered for accuracy.

Since the grids are scaled, an analysis of each stroke may be made. Using the tracking blocks, which may also be included on the film overlay sheets 150, an analysis of many strokes may be made. For example, the average distances using a 1 wood, a 5 iron, a 7 iron, etc., may be compiled over a period of time. Also, analyses of each hole played may be provided. Over a period of time, a player will know how to play or not play particular holes.

Figure 5:
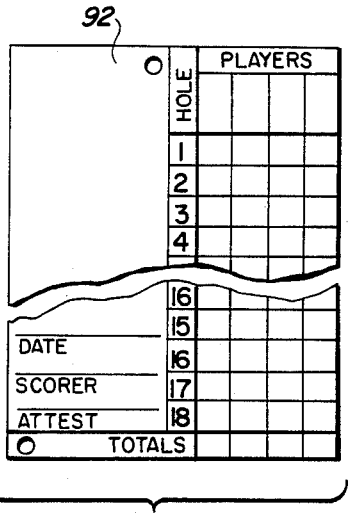
FIG. 5 is a plan view of another portion of the apparatus of the present invention.

FIG. 5 is a fragmentary view of a score card page 92, which is a no-carbon-required copy of the score card page 88. As indicated above, the score card page 88 is scored at 87 for easy removal of the page 88 so that the page 88 may be turned in at the end of a round of golf. The score card page 92, which is substantially identical to page 88, the remains in the booklet as a permanent record of a particular round of golf.

The score card page 92, substantially identical to the score card page 88, includes sufficient information for enabling four players to play a round of golf. The hole scores are sequentially listed from the top of the page to the bottom of the page, and totals for each player for a round are located at the very bottom of the page.

The score cards, both 88 and 92, are adapted to be used with the booklet apparatus 10 so that each hole line or box is sequentially uncovered as the pages are turned. In this manner, the score card is correlated with each of the primary or hole pages of the booklet 10. An incidental advantage to the sequential system of the booklet apparatus 10 of the present invention is that it is essentially impossible to mark a hole erroneously. That is, it is virtually impossible to mark for the wrong hole, since the "bottom line" showing is always for the hole being played.

FIGS. 6A, 6B, 6C, 6D, 6E and 6F are sequential illustrations showing or illustrating the use of the booklet apparatus of the present invention for recording hole information on the score card 88. In FIG. 6A, page 16, a primary or hole page for the first hole on a golf course is illustrated. In FIG. 6B, primary or hole page 20 is illustrated for the second hole on the course. In FIG. 6C, primary or hole page 24 for the third hole is shown. In FIG. 6D, primary page 36 for the sixth hole is shown. In FIG. 6E, primary page 72 for the fifteenth hole is shown, and in FIG. 6F, primary page 84 for the eighteenth hole is shown.

The relieved portion or cutout 17 of primary page 16, in FIG. 6A, allows the top or upper portion of the score card 88 to be seen. The portion includes the identification of the players and only the score information for the first hole. When page 16 is turned, at the completion of play for the first hole, the cutout 21 of page 20 uncovers the portion of the score card 88 which pertains to the second hole. Similarly, when page 20 is turned, and page 24 is displayed, the cutout 25 uncovers the portion of the socre card 88 which pertains to the third hole.

The cutout portions 17, 21, and 25 are sequentially lower so that the next succeeding lower portions of the score card are uncovered.

In FIG. 6D, primary page 36 for the sixth hole is shown. The cutout 37 uncovers the score card portion 88 for the sixth hole.

In FIG. 6E, primary page 72 for the fifteenth hole is shown. The cutout 73 uncovers the portion of score card 88 for the fifteenth hole.

Finally, the page 84, the primary page for the eighteenth hole, includes a side edge 85 which uncovers the portion of the score card page 88 pertaining to the hole 18. In addition, the edge 85 also uncovers the totals portion of the score card page 88. It is obvious that, if desired, edge 85, rather than being a right-hand page edge, could also be a cutout, like the cutout portions 17, 21, 25, 37, and 73, in FIGS. 6A, 6B, 6C, 6D, and 6E, respectively. In such case, the cutout would then only uncover the score car portion pertaining to the eighteenth hole. Page 84 would then have to be turned to provide access to the bottom of the score card where the totals are filled in for each player for the round of golf played.

It will be noted that each of the pages 16, 20, 24, 36, 72, and 84 in FIGS. 6A through 6F, respectively, include detailed information concerning the layout of each hole. The information includes a scaled diagram of the fairway 114, the rough and scrub areas 116 by the fairway, hazards 118, sand traps 120, and the greens 122. In addition, the pages may include grid lines, such as the grid lines 132 and 134, as shown in FIG. 3, distance arcs or lines 124, such as shown in FIGS. 2 and 3, and enlarged diagrams of the greens, such as the diagrams 140 illustrated in FIGS. 2 and 3. In addition, other information may be provided, as desired.

Figure 7:
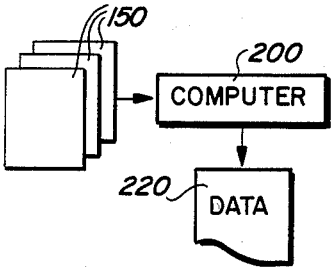
FIG. 7 is a schematic representation of the functioning of elements of the apparatus of the present invention to derive statistical information.

FIG. 7 is a schematic representation of the utilization of the apparatus of the present invention for compiling statistics regarding a player, particular drives with clubs, scores for holes, etc., as discussed above. A plurality of overlays 150 by each player, or the primary (hole) pages of the booklets 10, may provide information for an appropriate computer system 200 to provide statistical information on a hole-by-hole basis, and/or a club-by-club basis, for flight, distance, swing, and positioning information for individual evaluation, etc., as discussed above. Thus, players, upon receiving the statistical information, can evaluate performance statistics and can thereupon, hopefully, lower their scores and increase the enjoyment in their golf game.

In addition, both the overlay page 150 and/or each hole page provide a diagrammatic history of each round of golf played. The statistical information, together with the diagrammatic information, then allows the players to evaluate progress made over a period of time both on a hole-by-hole basis, when playing the same golf course, or simply on a time basis. Both strong points and weaknesses of a player's game are thus able to be charted.

It will be noted that the information depicted in the drawings, and discussed herein, is merely illustrative of the principles of the apparatus of the present invention. Obviously, the distances depicted for the golf course hole in FIG. 3 are illustrative. Similarly, the recitation of particular golf clubs in tracking blocks 126 and 128 of FIG. 3 is also purely illustrative.

For example, it is rather obvious that the hole and its distances depicted in FIG. 3 are not consistent distances of typical golf courses with respect to the distances shown by the grid configurations shown in FIG. 3 and in FIG. 4.

Moreover, it will be understood that since the lengths of typical holes vary from about 200 yards, a grid system laid out in ten yard increments will require different scales for different holes. The scale will be much smaller on the longer holes than the scale used for shorter holes. Accordingly, the term "universal" overlays used in the specification refers to different scales for holes of different lengths. For convenience, there may be three different scales used for different holes.

For relatively short holes, of about two hundred fifty yards maximum (par 3 holes) length, one scale, a relatively large scale, may be used. For medium length holes, of about two hundred fifty-one yards to about five hundred yards (par 4 and 5 holes) a second scale, a medium scale, may be used. For relatively long holes, of over five hundred yards in length (par 5 and 6 holes), a third scale, a relatively small scale, may be used. The use of the different scales allows greater flexibility in the depiction of the holes on virtually the same page area.

With respect to the grid system for the greens, it is similarly true that the sizes of greens vary. However, in all probability a common scale may be used to represent ten foot increments for the enlarged diagrams of the greens, as shown in FIGS. 2 and 3 for the enlarged green grid systems 140.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What we claim is:

1. Golf course information apparatus for a multi-hole golf course having fairways and greens, comprising, in combination:

booklet means, including a first plurality of pages, each of which includes a layout diagram of a hole of the golf course, a second plurality of pages facing the first plurality of pages for containing information, and a score card page for recording the strokes required for each hole of the golf course; and tracking means for recording and compiling statistical information for each golf hole played, including a computer system for compiling statistical information from the recorded information.

2. The apparatus of claim 1 in which the tracking means includes means for recording stroke information.

3. The apparatus of claim 2 in which the tracking means further includes means for recording the golf club used for each stroke.

4. The apparatus of claim 3 in which the tracking means further includes grid means for recording and marking a ball location for each stroke.

5. The apparatus of claim 4 in which the grid means includes a first grid system for marking fairway ball locations.

6. The apparatus of claim 5 in which the grid means further includes a second grid system for marking putting ball locations.

7. The apparatus of claim 1 in which the booklet means further includes cut-out portions on the first and second plurality of pages for sequentially uncovering the score card page for recording strokes for the hole played corresponding to each page of the first plurality of pages.

8. The apparatus of claim 1 in which the tracking means includes overlay means for the first plurality of pages for marking ball locations for each stroke.

9. The apparatus of claim 8 in which the overlay means includes a transparent film disposed on a page of the first plurality of pages.

10. The apparatus of claim 9 in which the overlay means further includes grid means for marking ball locations for each stroke.

11. The apparatus of claim 10 in which the grid means includes a first grid system for a fairway and a second grid system for a green.

* * * * *